US007378148B2

(12) United States Patent
Morton-Finger

(10) Patent No.: US 7,378,148 B2
(45) **Date of Patent: *May 27, 2008**

(54) MULTI-LAYER MONOFILAMENT AND PROCESS FOR MANUFACTURING A MULTI-LAYER MONOFILAMENT

(75) Inventor: Jürgen Morton-Finger, Weinheim (DE)

(73) Assignee: Motech GmbH Technology & Systems, Ober-Absteinach (DE)

( * ) Notice: Subject to any disclaimer, the term of this patent is extended or adjusted under 35 U.S.C. 154(b) by 0 days.

This patent is subject to a terminal disclaimer.

(21) Appl. No.: 11/266,570

(22) Filed: Nov. 3, 2005

(65) Prior Publication Data

US 2006/0051578 A1 Mar. 9, 2006

Related U.S. Application Data

(63) Continuation of application No. 10/772,162, filed on Feb. 3, 2004.

(30) Foreign Application Priority Data

Feb. 20, 2003 (DE) ..... 103 07 174

(51) Int. Cl.
*D02G 3/00* (2006.01)

(52) U.S. Cl. ..... 428/370; 428/373; 428/374

(58) Field of Classification Search ..... 428/370, 428/373, 374, 397
See application file for complete search history.

(56) References Cited

U.S. PATENT DOCUMENTS

| | | | | | |
|---|---|---|---|---|---|
| 3,616,130 | A * | 10/1971 | Rogosch et al. | ..... | 428/110 |
| 3,642,565 | A * | 2/1972 | Ogata et al. | ..... | 428/374 |
| 3,718,534 | A * | 2/1973 | Okamoto et al. | ..... | 428/374 |
| 4,323,626 | A * | 4/1982 | Kunimune et al. | ..... | 428/374 |
| 4,557,872 | A * | 12/1985 | Marsh et al. | ..... | 562/33 |
| 5,232,770 | A * | 8/1993 | Joseph | ..... | 442/345 |
| 5,470,657 | A * | 11/1995 | Hayami | ..... | 428/373 |
| 5,514,457 | A * | 5/1996 | Fels et al. | ..... | 442/191 |
| 5,780,155 | A * | 7/1998 | Ishizawa et al. | ..... | 428/370 |
| 5,981,408 | A * | 11/1999 | Nakagawa et al. | ..... | 442/199 |
| 6,680,117 | B2 * | 1/2004 | DeAngelis et al. | ..... | 428/372 |
| 6,949,288 | B2 * | 9/2005 | Hodge et al. | ..... | 428/370 |

* cited by examiner

*Primary Examiner*—N. Edwards
(74) *Attorney, Agent, or Firm*—Andrew Wilford

(57) ABSTRACT

A multi-layer monofilament consisting of multiple layers that are extruded simultaneously in a single process step, having a first layer made from plastic A, a second layer, which is bonded directly to the first layer, made from plastic b, and a third layer, which is bonded directly to the second layer, made from plastic C, plastic B being a bonding agent between the two plastics A and C.

16 Claims, 3 Drawing Sheets

MULTI-LAYER MONOFILAMENT AND PROCESS FOR MANUFACTURING A MULTI-LAYER MONOFILAMENT

CROSS REFERENCE TO RELATED APPLICATION

This application is a continuation of Ser. No. 10/772,162 filed 3 Feb. 2004 based upon German national application 103 07 174.1 of 20 Feb. 2003 under the International Convention and 35 USC 119 and 35 USC 120.

FIELD OF THE INVENTION

The invention relates to a multi-layer monofilament and, more particularly, to a method for manufacturing such a multi-layer monofilament and the monofilament made by that method.

BACKGROUND OF THE INVENTION

The principle of manufacturing or spinning two-layer monofilaments or bicomponent filaments from two different thermoplastic plastics is known. In this way, monofilaments receive corresponding properties, which cannot be achieved in one plastic alone.

It is known to produce these monofilaments from two layers either in a side-by-side arrangement or in a core/sheath arrangement. Many bicomponent filaments, particularly those with a core/sheath structure, have the disadvantage that the adhesion between the two layers (core and sheath) is inadequate and they can therefore easily delaminate. Particularly when these monofilaments are stretched, it often happens that the sheet layer peels away from the core like an onionskin. These problems occur in many plastic pairs.

OBJECTS OF THE INVENTION

An object of the invention is to provide an improved multi-layer monofilament of the type described at the outset which does not suffer from the problems explained above and in which the individual layers are adequately bonded with each other.

Another object of this invention is to provide a multilayer monofilament which resists delamination to a greater extent than has been the case heretofore and, in particular, is more stable than earlier laminated filaments.

It is also an object of this invention to provide a method of making a multilayer filament which has greater resistance to delamination.

SUMMARY OF THE INVENTION

These objects are achieved with a multi-layer monofilament consisting of multiple layers that the extruded or spun simultaneously in a single process step, having a first layer made from plastic A, a second layer, which is bonded directly to the first layer, made from plastic B, and a third layer, which is bonded directly to the second layer, made from plastic C, plastic B being a bonding agent between the two plastics A and C.

Multiple layers are said to be simultaneously extruded or spun in particular when the liquefied plastics intended for use in the multiple layers of the monofilament are ejected from the same spinning orifice or spinning device together, thereby creating the multi-layer monofilament. A spinning device of such kind is normally equipped with multiple spinning orifices.—For the purpose of the invention, a bonding agent is a plastic that serves to improve the adhesive bond between two plastics to be bonded.

The scope of the invention applies expressly to multiple-layer monofilaments including only three layers. Thus the filament of the invention is preferably a three-layer monofilament.

A highly advantageous embodiment, to which particular importance attaches within the scope of the invention, has a core/sheath structure, wherein the core of the monofilament is formed by plastic A, wherein this core is at least partly enclosed by the second layer consisting of plastic B, and wherein the second layer consisting of plastic B is at least partly enclosed by the third layer consisting of plastic C. In this core/sheath structure, the core consisting of plastic A is thus equivalent to the first layer consisting of plastic A. For practical reasons, the core has a circular or elliptical cross-section. The scope of the invention expressly includes the fact that the core is fully enclosed by the second layer consisting of plastic B, and that it preferably has a circular cross-section. According to a preferred embodiment, the second layer consisting of plastic B is entirely enclosed by the third layer consisting of plastic C and that it has a circular cross-section for practical purposes.

In all cases, the scope of the invention expressly includes the fact that a multi-layer monofilament according to the invention has a side-by-side structure.

According to one particularly preferred embodiment of the invention, plastic B, i.e. the adhesive agent, is an ethylene-vinylacetate copyolymer and/or a methacrylate copolymer.

Preferably, one of the two layers to be bonded by means of plastic B, i.e. by means of the bonding agent, i.e. the first layer consisting of plastic A or the third layer consisting of layer C, is made from at least one plastic from the group which consists of polyethylene terephthalate (PET), polyamide (PA), polyamide copolymer, polypropylene (PP). The scope of the invention expressly includes the fact that a polyamide 6 and/or polyamide 6.6 and/or polyamide 6.12 is used as the polyamide. According to a preferred embodiment of the invention, the other of the two layers to be bonded by means of plastic B, i.e. by means of the bonding agent, i.e. the first layer consisting of plastic A or the third layer consisting of layer C is made from at least one plastic from the group which consists of polyethylene (PE), polyoxymethylene (POM), polyphenylene sulphide (PPS), polymethylmethacrylate (PMMA), polybutylene terephthalate (PBT), polyvinyl chloride (PVC), polyether etherketone (PEEK), and polyethylene naphthalate (PEN).

In the process of the invention multi-layer monofilament is produced by means of a spinning device having a plurality of spinning orifices, wherein one liquefied plastic for each layer of the monofilament is directed to the respective spinning orifice and wherein the liquefied plastics for various layers are ejected from the spinning orifice together, thereby forming a single multi-layer monofilament.

According to a particularly preferred embodiment of the invention, a multi-layer monofilament having a core/sheath structure is produced, wherein the liquid plastic of plastic A is directed to each spinning orifice via a feeding channel provided centrally over the spinning orifice to form the core of the monofilament, wherein the liquefied plastic of plastic B (bonding agent) is directed to form an inner sheath via an inner feeding slit encircling the feeding channel in annular manner, and wherein the liquefied plastic of plastic C is directed to form an outer sheath via an outer feeding slit encircling the inner, annular feeding slit. The scope of the invention expressly provides for the fact that the inner and/or the outer feeding slits is/are feeding slits that encircle the feeding channel in an annular manner.

According to a particularly preferred embodiment of the invention, the multi-layer monofilaments are stretched after spinning. Stretching is advantageously done in one to three stages. Stretching may take place in air, or in steam or in water.

The invention is based on the realization that the layers of the multi-layer monofilaments according to the invention adhere to each other surprisingly strongly. When these multi-layer monofilaments are stretched, the layers do not delaminate. In addition, the multi-layer monofilaments according to the invention may be manufactured relatively simply and inexpensively.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
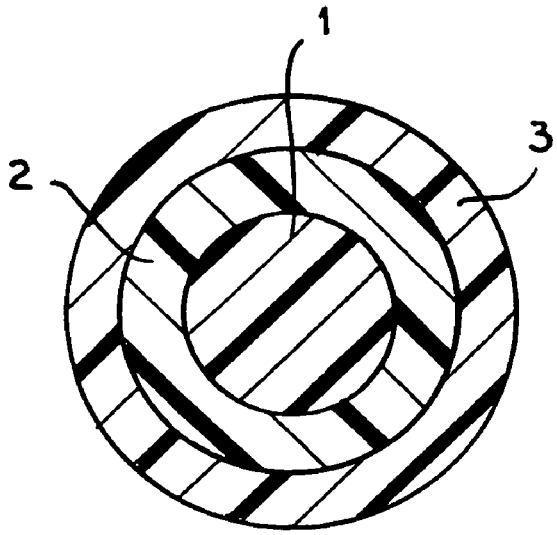
FIG. 1 is a transverse cross section drawn to a greatly enlarged scale and diagrammatically showing a multilayer monofilament according to the invention.

In the embodiment shown in FIG. 1, the multi-layer monofilament is formed as a three-layer monofilament specifically having a core/sheath structure. Core 1 here corresponds to the first layer of the multi-layer monofilament made from plastic A. Preferably and in the embodiment, core 1 has a circular cross-section. In the embodiment shown in this FIGURE, this core 1 is surrounded by an inner sheath 2, which corresponds to the second layer consisting of plastic B, i.e. the bonding agent. Inner sheath 2 surrounds core 1 in an annular manner. This inner sheath 2 is in turn surrounded by an outer sheath 3, which corresponds to the third layer consisting of plastic C. This outer sheath 3 surrounds inner sheath 2 consisting of plastic B in annular manner. In this embodiment, inner sheath 2 may consist of ethylene vinylacetate copolymer as a bonding agent.

Figure 2:
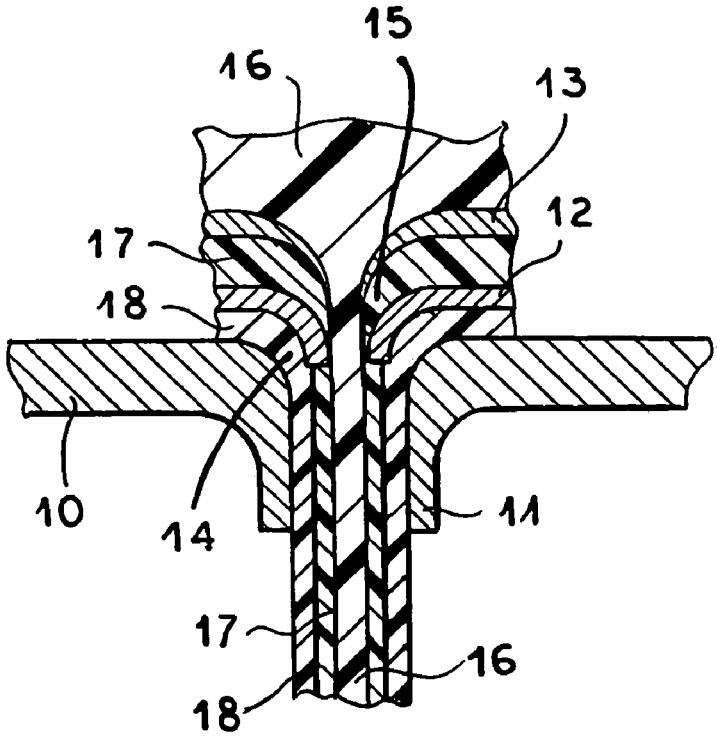
FIG. 2 is a section through one orifice of a multiorifice spinning head for producing the monofilament of the invention.
Figure 3:
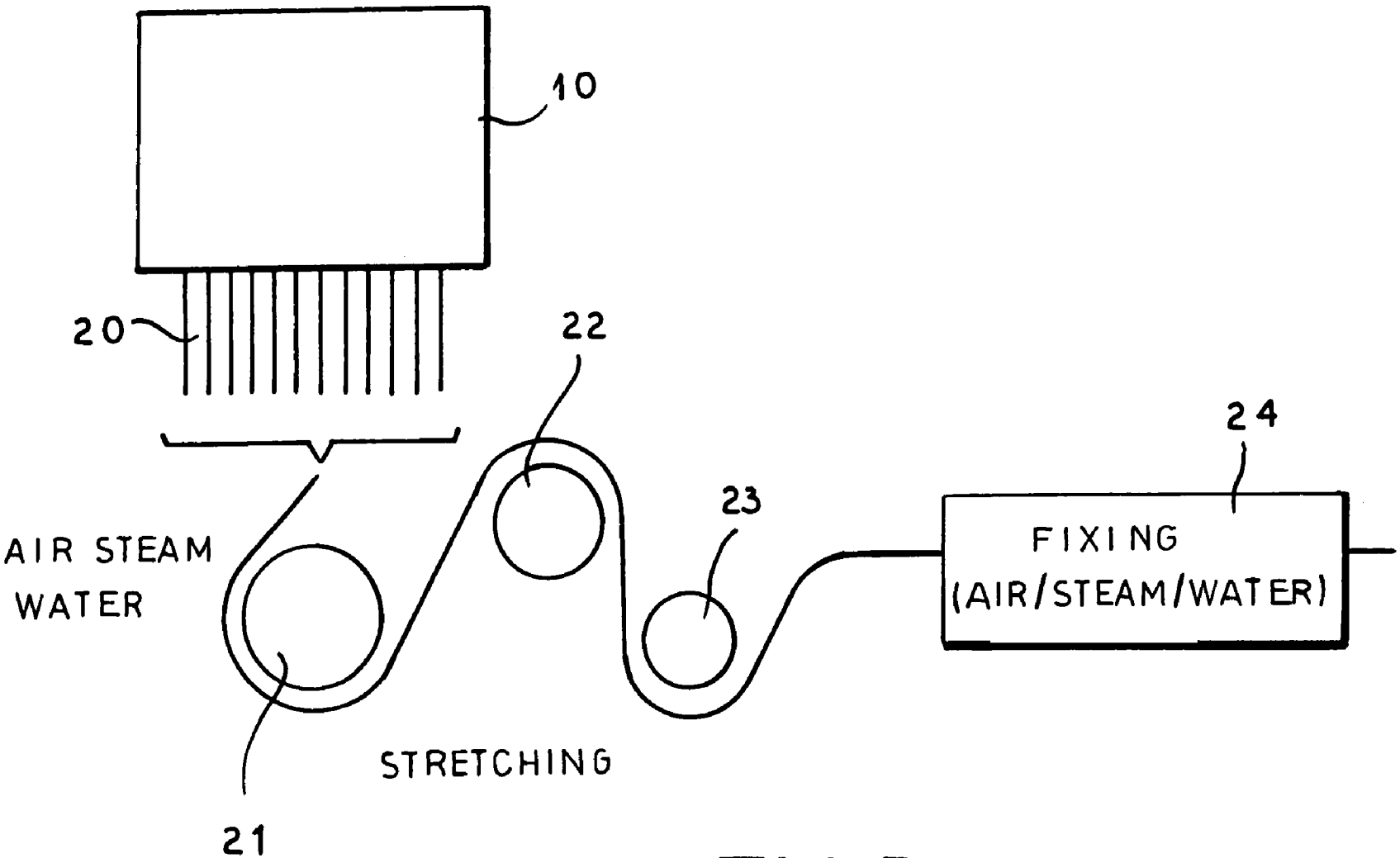
FIG. 3 is a diagram of an apparatus for producing monofilament in accordance with the principles of this invention.
Figure 4:
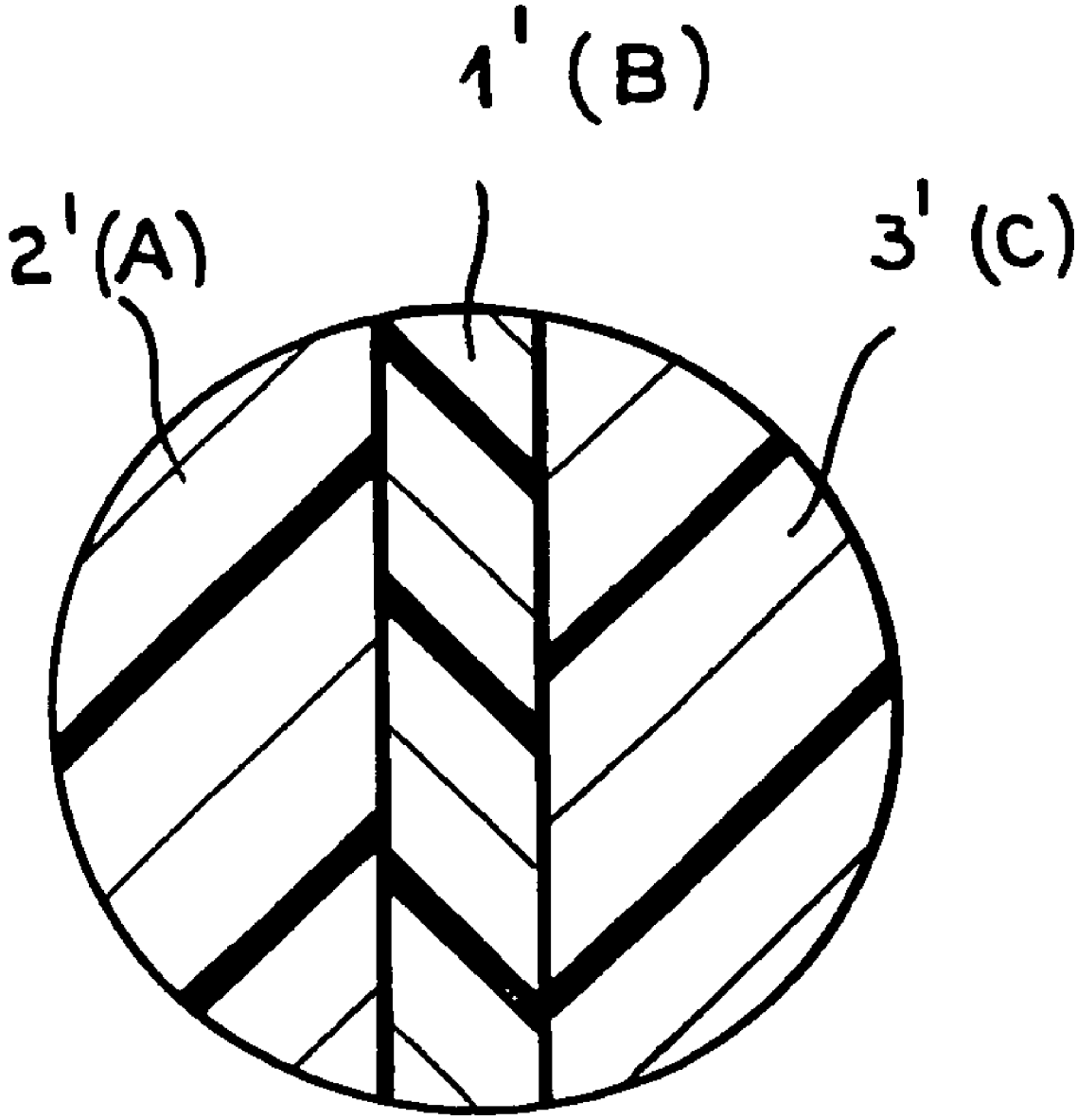
FIG. 4 is a section similar to FIG. 1 showing the side-by-side structure.

In FIG. 2 I have shown a multiorifice spinning head 10, one orifice of which is visible at 11. As can be seen from FIG. 2, the office 11 is associated with guides 12 and 13 which define annular slits 14 and 15. The core synthetic resin, here seen at 16 passes through the guide 13 and is surrounded by the bonding plastic 17 which is applied through the annular slit 15 as an inner sheath to the core. The outer sheath, which is applied by rolls 21, 22, and 23 which are successively driven with greater peripheral speeds. The stretching is carried out in air, in steam or in water. After stretching, the monofilaments are fixed at 24 by heating in air, steam or water as has previously been described.

I claim:

1. A stretched monofilament comprising a continuous stretched and heat-set first layer consisting of at least one plastic selected from the group consisting of polyethylene terephthalate, polyamide, and polyamide copolymer, a continuous stretched and heat-set plastic second layer at least partially enclosing, bonded to, and extending a full length of the first portion, and a continuous stretched and heat-set third layer at least partially enclosing, bonded to, and extending a full length of the second layer and having a composition different from that of the first layer and selected from the group consisting of polyethylene, polyoxymethylene, polyphenylene sulfide, polymethylmethcrylate, polybutylene terephthalate, polyether etherketone and polyethylene naphthalate, the second layer being sandwiched between the first layer and third layer.

2. The monofilament defined in claim 1 wherein the monofilament has a core/sheath structure with the first layer constituting a core, the second layer forming a sheath surrounding and wholly enclosing the core, and the third layer forming a sheath surrounding and wholly enclosing the second layer and the core.

3. The monofilament defined in claim 2 wherein the core is of substantially circular section.

4. The monofilament defined in claim 3 wherein the core is of substantially elliptical section.

5. The monofilaznent defined in claim 1 wherein the monofilament has a side-by-side structure with the second layer bonded on one side to the first layer and on an opposite side to the third layer.

6. The monofilament defined in claim 1 wherein the second layer is an adhesive agent.

7. The monofilament defined in claim 1 wherein the second layer is an ethylene-vinylacetate copolymer or a methacrylate copolymer.

8. The monofilament defined in claim 1 wherein the second layer is a methacrylate copolymer.

9. A stretched monofilament comprising:

a continuous stretched and heat-set first layer consisting of at least one plastic selected from the group consisting of polyethylene terephthalate, polyamide, polyamide copolymer and polypropylene, a continuous stretched and heat-set plastic second layer at least partially enclosing, bonded to, and extending a full length of the first portion, and a continuous stretched and heat-set third layer at least partially enclosing, bonded to, and extending a full length of the second layer and consisting of a plastic having a different composition from that of the first layer and selected from the group consisting of polyoxymethylene, polyphenylene sulfide, polymethylmethcrylate, polybutylene terephthalate, polyether etherketone and polyethylene naphthalate, the second layer being sandwiched between the first layer and third layer.

10. The monofilament defined in claim 9 wherein the monofilament has a core/sheath structure with the first layer constituting a core, the second layer forming a sheath surrounding and wholly enclosing the core, and the third layer forming a sheath surrounding and wholly enclosing the second layer and the core.

11. The monofilament defined in claim 10 wherein the core is of substantially circular section.

12. The monofilament defined in claim 11 wherein the core is of substantially elliptical section.

13. The monofilament defined in claim 9 wherein the monofilament has a side-by-side structure with the second layer bonded on one side to the first layer and on an opposite side to the third layer.

14. The monofilament defined in claim 9 wherein the second layer is an adhesive agent.

15. The monofilament defined in claim 9 wherein the second layer is an ethylene-vinylacetate copolymer.

16. The monofilament defined in claim 9 wherein the second layer is a methacrylate copolymer.

* * * * *